US005544865A

United States Patent [19]

Abbaticchio

[11] Patent Number: 5,544,865

[45] Date of Patent: Aug. 13, 1996

[54] RAIL SUPPORT BRACKET

[76] Inventor: Michael T. Abbaticchio, 16017 Comus Rd., Clarksburg, Md. 20871

[21] Appl. No.: 358,094

[22] Filed: Dec. 16, 1994

[51] Int. Cl.[6] ..... E04F 11/18

[52] U.S. Cl. ..... 256/67; 256/65; 403/22; 403/3

[58] Field of Search ..... 256/67, 65, 59; 403/22, 3, 4

[56] References Cited

U.S. PATENT DOCUMENTS

| | | | |
|---|---|---|---|
| 2,886,278 | 5/1959 | Opie | 256/65 X |
| 3,328,057 | 6/1967 | Murdock | 256/59 X |
| 3,544,072 | 12/1970 | Thom | 256/65 X |

FOREIGN PATENT DOCUMENTS

| | | | |
|---|---|---|---|
| 504976 | 9/1992 | European Pat. Off. | 248/49 |
| 4-353154 | 12/1992 | Japan | 256/59 |

*Primary Examiner*—Anthony Knight
*Attorney, Agent, or Firm*—Dickinson, Wright, Moon, Van Dusen & Freeman

[57] ABSTRACT

A support bracket for protective railing may be adjustably positioned on a wall or other surface. The bracket is constructed such that when the bracket is loosely assembled, the placement of a rail segment on the bracket may be adjusted as desired within a limited range in one or more directions. After the placement of the rail segment has been adjusted, the component parts of the bracket are tightened to fix the rail segment in place. When assembled, the bracket forms a sealed unit with a smooth exterior that has a minimal tendency to collect dust, dirt and bacteria and that is easy to clean.

13 Claims, 2 Drawing Sheets

RAIL SUPPORT BRACKET

TECHNICAL FIELD

This invention relates generally to the art of protective railing, and in particular to an adjustable support bracket for railing segments that allows the segments to be assembled easily into a uniform unit without precise alignment of the support brackets and the individual rail segments.

BACKGROUND

Various types of railing and brackets for such railing are known to the prior art. Railing is typically formed by the end-to-end alignment of a number of railing segments, to allow the segments to be of reasonable size. The segments are attached to the walls by brackets that hold the segments in proper alignment so as to give a unitary appearance to the railing. The walls on which railing is to be installed may have depressions, protrusions, and other irregularities, however, which makes alignment of the segments difficult.

In conventional railing systems, the placement of the brackets on a supporting surface must be carefully determined and the rail segments and brackets must be carefully aligned such that the rail segments abut one another in an aesthetically pleasing fashion. This is often difficult to achieve due to slight variances in the placement of the brackets on the wall and in the length of the rail segments. These variances cause misalignment of the railing segments, thus detracting from the aesthetic appeal of the railing and resulting in gaps which can snag passing objects. Accordingly, the installation of railing systems to produce a uniform railing is time consuming and expensive.

There is thus a need for a protective railing system that is tolerant of slight variances in the placement of the supporting brackets along a wall and in which the placement of the railing segments on the supporting brackets is adjustable in one or more directions to compensate for such variances.

Another problem with brackets currently known in the art is that these brackets have irregular surfaces. For example, one commonly used bracket is I-shaped and consists of opposing flanges which are separated by an intermediate web. One of the flanges is attached to the wall, and the other of the flanges is attached to the rail section. The intermediate web holds the rail from the wall by the desired distance. The irregular surfaces of such a structure are undesirable, particularly when the bracket is to be used in hospital rooms and corridors and in other sanitary environments, because such surfaces collect dust, dirt and bacteria and are difficult to clean.

There is thus a need for a bracket that is easy to clean and that resists dust accumulation.

These and other objects are accomplished by the present invention as hereinafter disclosed.

SUMMARY OF THE INVENTION

The present invention is a novel support bracket for a protective railing system. When the bracket is loosely assembled, the rail segment attached to the bracket may be adjusted in one or more directions. After the position of the rail segment has been set, the component parts of the bracket are then tightened to fix the rail segment in the desired orientation. In addition, when the bracket is fully assembled, it is completely sealed and offers a surface that is easy to clean and resists the accumulation of dust.

DETAILED DESCRIPTION OF THE PREFERRED EMBODIMENT

Figure 1:
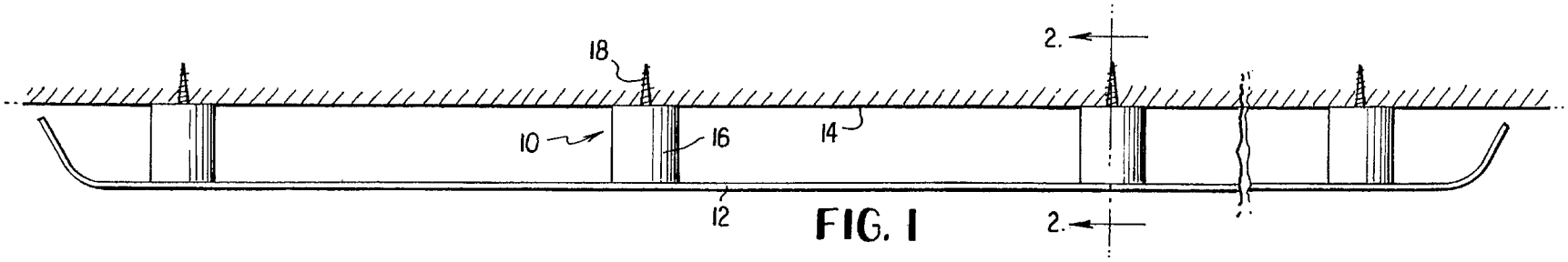
FIG. 1 is a top view of a rail system utilizing brackets in accordance with the present invention.

FIG. 1 shows the use of the brackets 10 of the present invention in supporting protective railing 12 on a wall 14. The brackets may be placed in any configuration suitable for supporting railing on a wall, although, in use, the placement of the brackets will often be dictated by the configuration of the room. In order to provide proper support for the railing, it is preferred that the brackets are installed in such a way that the maximum distance between brackets is no greater than 3'.

The bracket of the present invention preferably has a hollow cylindrical housing 16 which has a height of about 3", an interior diameter of about 2.6", and a wall thickness of about 0. 090". The housing is preferably made of material such as anodized aluminum which has a smooth outer surface, is aesthetically pleasing, and eliminates irregular surface areas that can collect dust, dirt and bacteria. In the most preferred embodiment, the housing is made of extruded 6061-T6 aluminum alloy, Fed. Spec. QQA-200/8, which is anodized with sulfuric acid. The housing is secured to the wall by a set of screws 18 or by other suitable attachment means as are known to the art.

Figure 4:
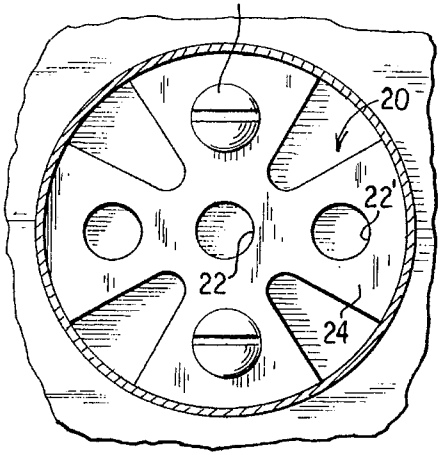
FIG. 4 is a cross section taken along line 4—4 of FIG. 2, showing the means by which the bracket is adjustably secured to the wall.
Figure 2:
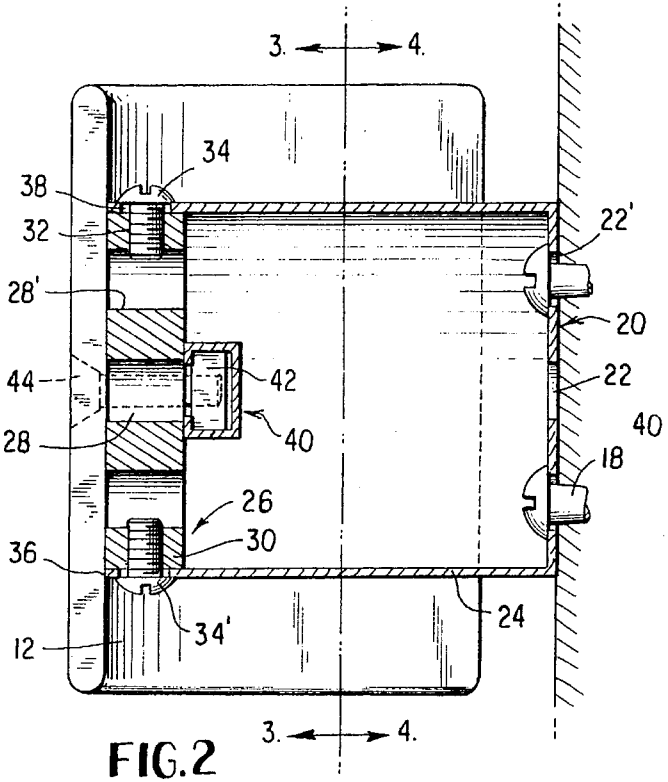
FIG. 2 is a cross section taken along line 2—2 of FIG. 1.

FIGS. 2 and 4 show the attachment of the bracket to the wall. The housing of the bracket is open on one end and terminates on the other end in a cross-shaped plate 20 which is provided with a set of holes 22, 22', including a central hole 22 in the center of the plate and a hole 22' in each arm 24 of the plate, through which the set of screws 18 are inserted when the housing is attached to a wall. The holes 22, 22' are preferably about ⅜" in diameter. The type of screws used will depend on the surface to which the bracket is to be mounted, and include, for example, molly or toggle bolts for use on hollow walls. Other devices as are known to the art, such as PVC anchors, may be used in conjunction with the screws to anchor the bracket more securely to the surface. In addition, the particular holes used may also vary with the surface. For example, the central hole 22 may be used when the installation of the bracket requires the use of a molly or toggle bolt, while the holes 22' in the arms of the plate may be used when the bracket is mounted on solid wood or block, or when the bracket is mounted on a hollow wall with a metal backing plate.

To attach the housing to a wall, the housing is oriented so that the plate 20 abuts the portion of the wall to which the housing is to be attached. The screws 18 are then inserted through one or more of the holes 22, 22' in the plate and are driven into the wall. The diameters of the screws 18 are preferably smaller than the diameters of the holes in the plate, thus permitting the housing to be adjusted parallel to the wall within a limited range of motion before the screws are completely tightened. Preferably, the maximum shaft diameter of the screws is about ¼" compared to the preferred hole diameter of about ⅜".

Figure 3:
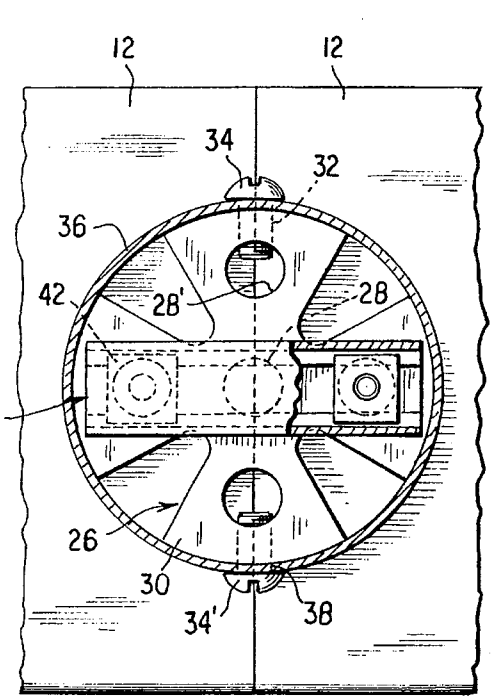
FIG. 3 is a cross section taken along line 3—3 of FIG. 2, showing the means by which the railing is adjustably secured to the bracket.
Figure 5:
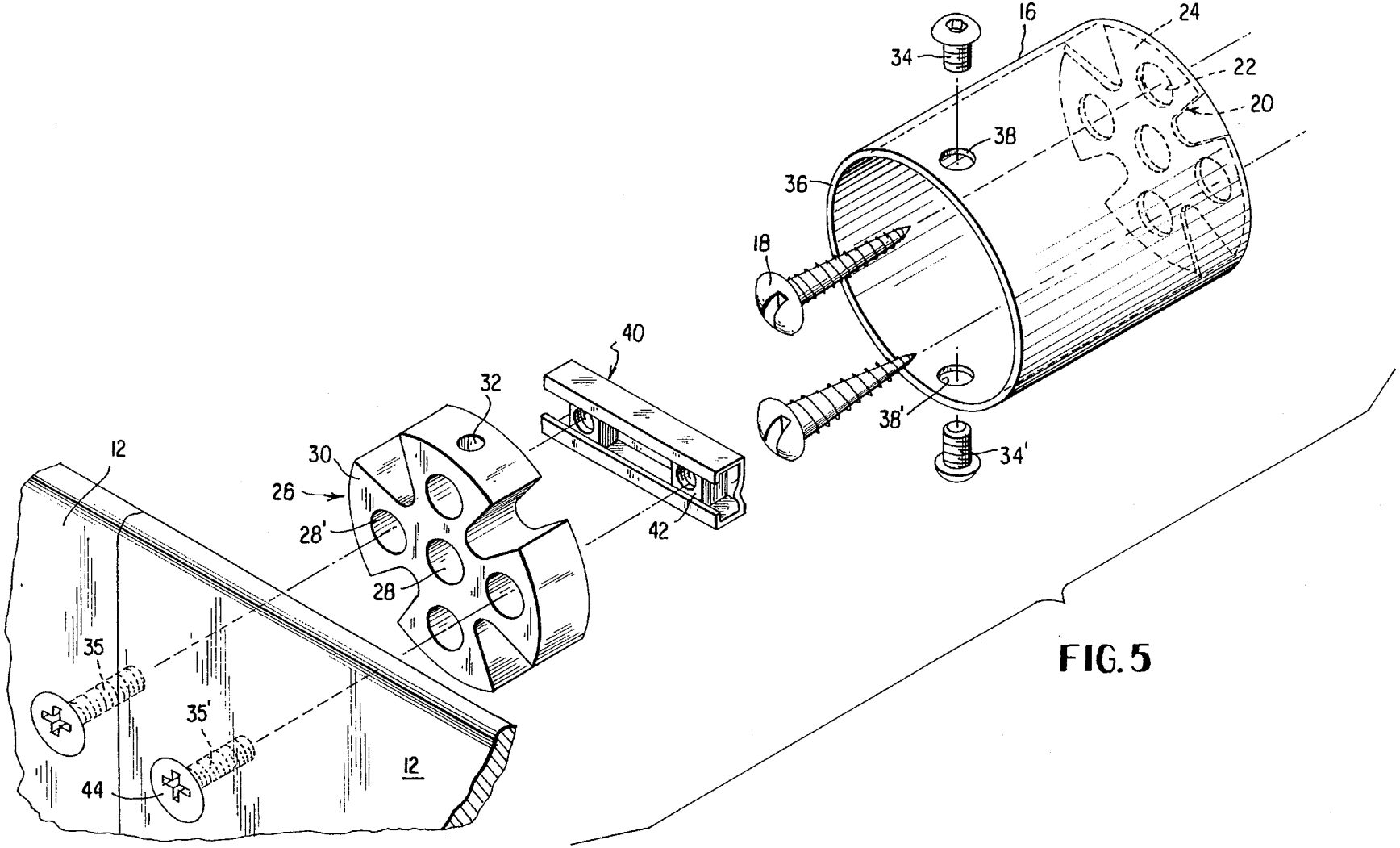
FIG. 5 is an exploded view of the bracket of the present invention.

FIGS. 2, 3, and 5 shows the preferred means by which a segment of railing is attached to the bracket. The bracket is provided with a flat, cross-shaped support disc 26 which is about 2.38" in diameter and which has a thickness of about ½". The support disc is provided with a set of holes 28, 28', each of which has a radius of about ⅜". A central hole 28 is located in the center of the support disc, and additional holes 28" are located on each arm 30 of the support disc. In addition, at least two of the arms of the support disc are provided with side holes 32 for accommodating a set of screws 34, 34' which connect the support disc to the housing 16. The side holes 32 are preferably tapped to receive a machine screw having a shaft diameter of about ¼".

As shown in FIG. 5, the distance between opposing holes 28" on the support disc coincides with the distance between the holes 35, 35' on abutting segments of railing. This allows a bracket of the present invention to be placed over the joint formed by abutting segments of railing, where it serves to hold the segments together.

The lip of the housing 16 is provided with a third set of holes 38, 38' for accommodating a set of screws 34. The diameters of the holes 38, 38' are larger than the diameters of the screws 34, thus permitting the support disc to move in each direction within a limited range of motion relative to the rail and relative to the housing before the screws are completely tightened. In the preferred embodiment, the holes 38, 38' have diameters of about 0.34" and are used in conjunction with stainless steel button head machine screws having shaft diameters of about ¼".

The bracket is also preferably provided with a floating nut retainer 40. The nut retainer is disposed on the opposite side of the support disc from the railing and has a c-shaped cross section that is crimped on each end. The nut retainer loosely houses a set of nuts 42 which engage a third set of screws 44. The screws 44 secure the railing to the disc 26 and, in turn, to the housing 16. The nut retainer prevents the rotation of the nuts, while permitting them to slide freely along its length. In the preferred embodiment, the screws 44 are 1" stainless steel machine screws with shaft diameters of about ¼" and the nuts are square nuts with an interior diameter of about ¼". The nut retainer is preferably about 2.188" long, 0.375" deep and 0.625" wide.

The screws 44 are inserted through the holes 28' in the support disc and secured to the nuts 42. The diameters of the holes 28' are larger than the diameters of the screws 44 to permit the support disc to move in each direction within a limited range of motion relative to the bracket and relative to the rail before the screws have been completely tightened.

In operation, the bracket 16 is secured to a wall by screws 18, and the support disc 26 is loosely secured to the rail 12 and to the housing. When the rail is properly aligned, all three sets of screws are tightened, thereby fixing the components of the bracket in place and rigidly affixing the railing to the wall. The assembled bracket is completely sealed, and has only smooth outer surfaces which are easy to clean and which have a minimal tendency to collect dust, dirt and bacteria.

The above disclosure is intended only to convey an understanding of the present invention to those skilled in the art, and is not intended to be limiting. It will be appreciated that various modifications to the disclosed embodiments are possible without departing from the scope of the invention. Therefore, the scope of the present invention should be construed solely by reference to the appended claims.

I claim:

1. In combination with a rail segment, a bracket for mounting said rail segment on a surface, said bracket comprising:

first fastening means for fastening said bracket to the surface;

second fastening means for fastening said bracket to said rail segment, wherein said second fastening means is adjustable from a first state in which it loosely attaches said bracket to said rail segment and allows said rail segment to be shifted, within a limited range of motion, into a desired orientation relative to said bracket, to a second state in which it tightly secures said rail segment to said bracket in the desired orientation;

wherein said bracket further comprises:

housing means for housing said first and second fastening means; and wherein said second fastening means further comprises: a support disc;

third fastening means for fastening said support disc to said housing means; and fourth fastening means for fastening said support disc to said rail segment.

2. The combination of claim 1, wherein said support disc is cross-shaped.

3. The combination of claim 2, wherein said rail segment is provided with at least one second hole, wherein said support disc is provided with at least one third hole, and wherein said fourth fastening means comprises at least one screw inserted through said second and third holes.

4. The combination of claim 3, wherein said third hole has a diameter that is sufficiently larger than the maximum diameter of the shaft of said screw so that said screw moves freely, within a limited range of motion, within said third hole before said screw is completely tightened.

5. The combination of claim 4, wherein the ratio of said third hole to the maximum diameter of the shaft of said screw is approximately 0.34:0.25.

6. The combination of claim 3, wherein said screw rotatably engages at least one nut disposed on the opposite side of said support disc from said rail segment.

7. The combination of claim 6, wherein said fourth fastening means further comprises nut retention means for slidingly housing said nut and for preventing the full rotation of said nut.

8. The combination of claim 7, wherein said first fastening means comprises:

a plate attached to the interior of said housing means and provided with at least one hole, and a screw, and wherein the diameter of the hole is sufficiently larger than the maximum diameter of the shaft of said screw so that said screw moves freely, within a limited range of motion, within said third hole before said screw is completely tightened.

9. The combination of claim 1, wherein the side of said support disc is provided with at least one threaded hole, and wherein said third fastening means comprises at least one screw which extends through a first hole in the side of said housing means and which rotatably engages said threaded hole.

10. The combination of claim 9, wherein said first hole has a diameter that is sufficiently larger than the maximum diameter of the shaft of said screw so that said screw moves freely, within a limited range of motion, within said first hole before said screw is completely tightened.

11. The combination of claim 10, wherein the ratio of said first hole to the maximum diameter of the shaft of said screw is approximately 0.34:0.25.

12. The combination of claim 1, wherein said bracket has a smooth exterior surface.

13. The combination of claim 12, wherein said exterior surface is cylindrical.

* * * * *